US005169226A

United States Patent [19]

Friedman

[11] Patent Number: 5,169,226

[45] Date of Patent: Dec. 8, 1992

[54] PORTABLE DESK LIGHT

[76] Inventor: Arthur S. Friedman, 2144 Seneca West, Merrick, N.Y. 11566

[21] Appl. No.: 878,392

[22] Filed: May 4, 1992

[51] Int. Cl.[5] ..... F21L 7/00

[52] U.S. Cl. ..... 362/190; 362/197; 362/199; 362/413; 362/427

[58] Field of Search ..... 362/190, 197, 198, 199, 362/200, 427, 413

[56] References Cited

U.S. PATENT DOCUMENTS

| | | | |
|---|---|---|---|
| D. 202,728 | 11/1965 | Koch | D48/20 |
| D. 203,215 | 12/1965 | Koch | D48/20 |
| D. 213,902 | 4/1969 | Muller | D48/20 |
| D. 217,830 | 6/1970 | Heller | D48/20 |
| 1,247,346 | 11/1917 | Stern | 362/413 |
| 2,543,926 | 3/1951 | Mounique | 362/413 |
| 2,740,039 | 3/1956 | Phillips | 362/413 |
| 3,393,312 | 7/1968 | Dahl | 362/190 |
| 3,479,499 | 11/1969 | Dahl | 362/198 |
| 3,961,175 | 6/1976 | Otagoshi | 362/199 |
| 4,598,340 | 7/1986 | Dwosh et al. | 362/199 |
| 4,706,172 | 11/1987 | Lebowitz | 362/413 |
| 4,751,620 | 6/1988 | Wright et al. | 362/99 |
| 4,893,221 | 1/1990 | Friedman | 362/199 |
| 4,958,913 | 9/1990 | Schaffer | 362/253 |
| 4,974,130 | 11/1990 | Friedman | 362/199 |
| 5,016,153 | 5/1991 | Gismondi et al. | 362/413 |

*Primary Examiner*—James C. Yeung

*Attorney, Agent, or Firm*—Dennison, Meserole, Pollack & Scheiner

[57] ABSTRACT

A portable desk light including a flat thin battery case with laterally spaced battery chambers defining an upwardly opening channel therebetween. The channel receives an elongate support arm pivoted therein for movement between a first position completely received within the channel and an upwardly pivoted and longitudinally extended position. A bulb mounting lamp housing is pivoted to the upper end of the support arm for positioning relative to a support surface upon which the battery case rests.

15 Claims, 2 Drawing Sheets

FIG. 4
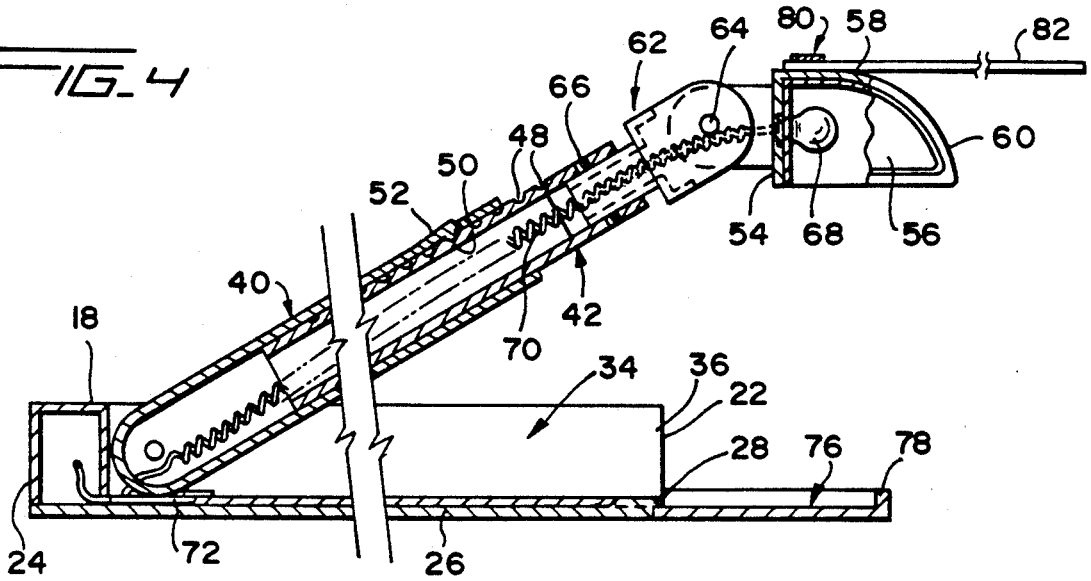
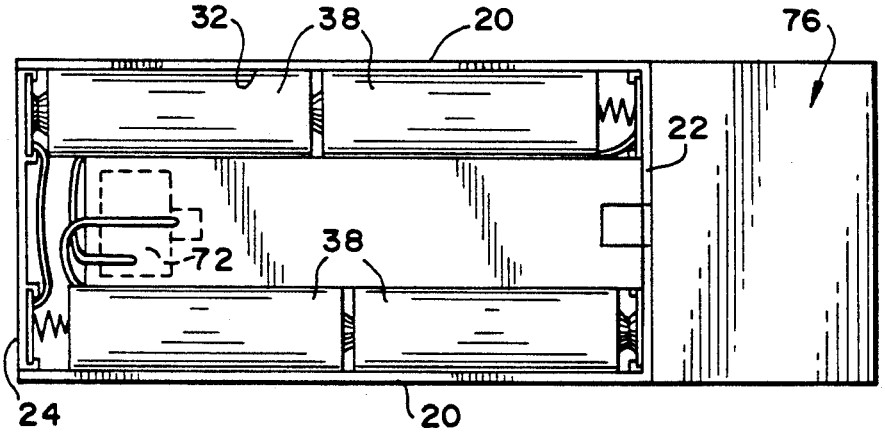
FIG. 5
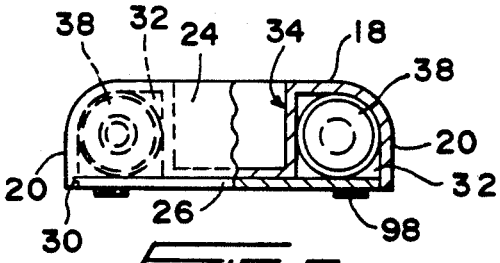
FIG. 6
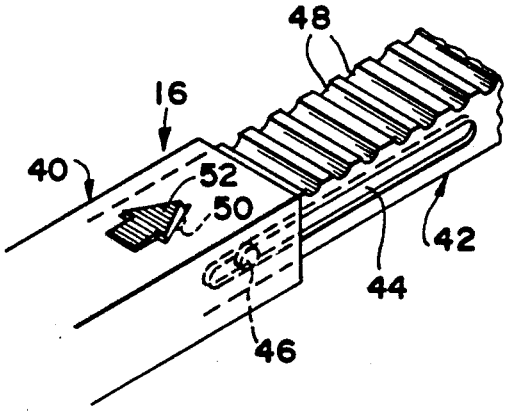
FIG. 7
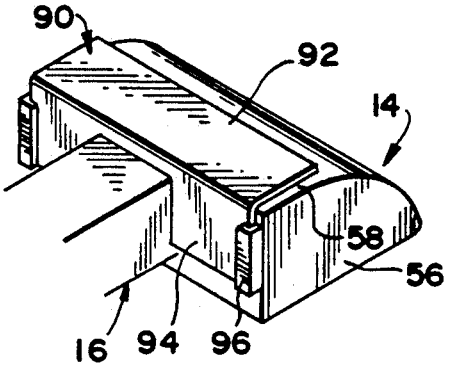
FIG. 8

PORTABLE DESK LIGHT

BACKGROUND OF THE INVENTION

The invention broadly relates to portable lights incorporating a bulb and a battery power source.

Such portable lights take many forms, from the conventional cylindrical flashlight to compact thin profile devices adapted to be conveniently carried on one's person as exemplified in applicant's prior U.S. Pat. No. 4,893,221, issued Jan. 9, 1990, and U.S. Pat. No. 4,974,130, issued Nov. 27, 1990.

The lights of these two patents are particularly adapted for "hands free" use, supported by a neck strap and adjustable to illuminate a hand-held item such as a book, a menu, or the like. When used in this manner, after an initial adjustment and positioning of the light on the user, the material to be viewed is normally manually shifted to achieve maximum benefit of the light. As will be appreciated, any shift in the body of the user will normally require a readjustment to best accommodate to the light.

If one has the work positioned on a stable surface, whether this be a desk top, a seat tray in an airplane, or even a lap top computer, temporarily positioned on top of an attache case on one's lap, the use of a body-mounted light which is constantly moving relative to the rather stable positioning of the workpiece can be distracting.

SUMMARY OF THE INVENTION

The goals of the present invention basically involve the provision of a self-contained light source which combines the compactness, portability and versatility of the lights of the above two patents with the additional advantages of being mountable on a desk top or the like and useable in the manner of a desk light.

The light, when closed, is quite compact with a thin profile for convenient storage within an attache case, or even in one's jacket pocket. As an example, it is contemplated that the desk light in its preferred embodiment, and when closed, will be approximately 57 millimeters wide, 152 millimeters long and 20 millimeters high.

When open in its use position, the light will include a stable base adapted to sit on a tabletop or the like and an elevated source of illumination, in the nature of a conventional bulb positioned within a downwardly directed lamp housing, located at an appropriate height over the work surface, normally approximately 4" (102 mm) above the reading matter or workpiece.

It is also a significant object of the invention to provide a portable desk light which is adjustable in the use configuration to vary the position of the lamp housing in accord with the nature of the work to be illuminated. For example, while a 4" (102 mm) spacing is preferred for reading matter, a 2" (51 mm) height might be preferred for close work, such as working with stamps, jewelry repair, or the like. With regard to close work in particular, it is also contemplated that the portable desk light be adapted to mount and position a magnifier, normally in sheet form.

Basically, the portable desk light includes an elongate battery case with a flat base, two elongate battery chambers and an elongate upwardly and forwardly opening channel defined between the chambers. A telescopically extensible support arm is pivoted to the inner end of the channel and mounts, for limited universal movement on the outer end thereof, a lamp housing. Upon a complete collapsing of the arm inward on itself, and a downward pivoting of the arm into the channel, the arm itself will be completely received within the channel with the lamp housing positioned immediately forward of the battery case and engaged on a forwardly projecting closure plate which closes the bulb compartment in the housing.

The battery case provides a flat support base for the extended lamp arm with the weight of the batteries received within the laterally spaced battery compartments effectively counteracting any tendency for the extended arm and lamp housing to overbalance the desk light. The adjustability of the lamp housing on the outer end of the extensible arm allows for a proper directing of the illumination regardless of the angular orientation of the arm within practical limits. The lamp housing itself will mount a small clip adapted to receive and position a thin, lightweight magnifier over the work area and above the light source itself to both provide the desired magnification and avoid annoying light reflections on the magnifier lens.

Additional objects and advantages of the invention will be recognized from the more detailed description of the invention following hereinafter.

BRIEF DESCRIPTION OF THE DRAWINGS

FIG. 4 is a longitudinal cross-sectional view through the open desk light;

FIG. 5 is a bottom plan view with the bottom closure panel removed;

FIG. 6 is a rear elevational view with a portion broken away;

FIG. 7 is a perspective detail of the relationship between the telescoping arm components; and FIG. 8 is a perspective detail of the lamp housing illustrating a modified form of magnifier clip.

DESCRIPTION OF PREFERRED EMBODIMENTS

Figure 1:
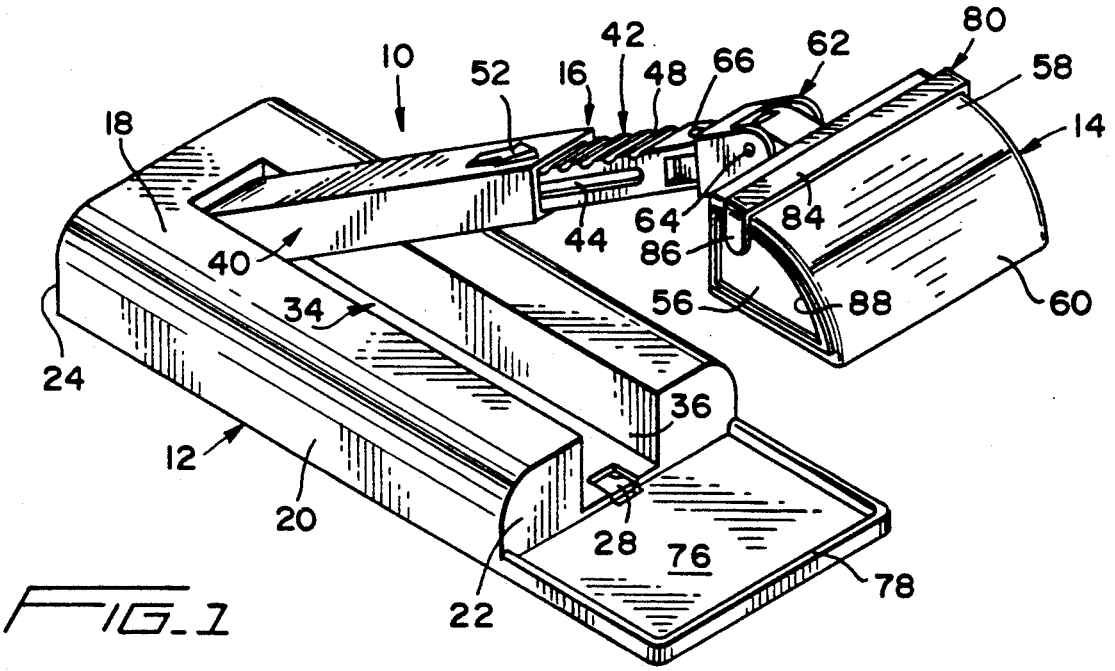
FIG. 1 is a perspective view of the desk light in its open in-use position.
Figure 2:
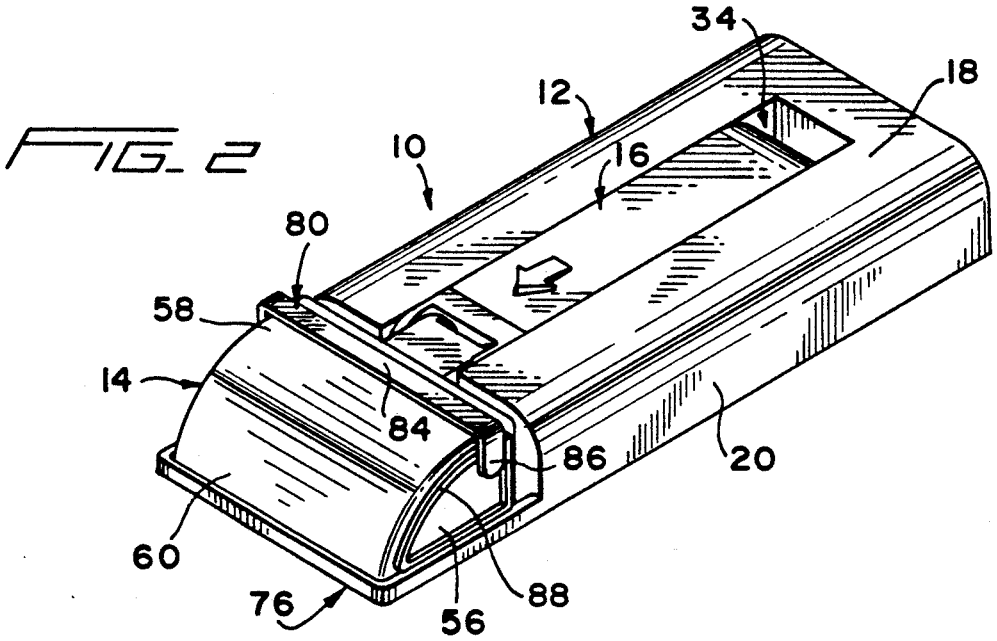
FIG. 2 is a perspective view of the desk light in its closed compacted position.
Figure 3:
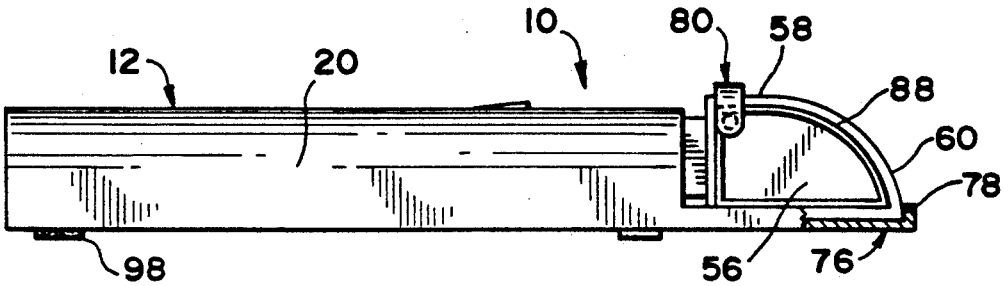
FIG. 3 is a side elevational view of the closed desk light with a portion broken away.

Referring now more specifically to the drawings, the portable light 10 basically includes an elongate flat rectangular battery case 12, a generally rectangular lamp housing 14 and a telescopically extensible support arm 16 mounting the lamp housing 14 to the battery case 12.

The battery case 12 includes a flat top or upper face panel 18 with integral depending opposed longitudinal side walls 20, a front end wall 22 and a rear end wall 24. As illustrated, the longitudinal upper edges between the top panel 18 and each side wall 20 are preferably arcuate. The interior of the case is hollow and is closed by a removable planar bottom panel 26 having a forwardly directed latching tongue 28 integral therewith and extending centrally therefrom for selective snap-engagement within a complementary slot in the front end wall 22. The bottom panel also includes a pair of laterally directed ears 30 adjacent the rear edge of the bottom panel 26 for sliding engagement with complementary notches in the opposed inner faces of the side walls 20 which depend slightly below the rear end wall 24 for the accommodation of the bottom panel 26 therebetween as will be best noted in FIG. 6. It will thus be recognized that a slight sliding movement will be required to engage and disengage the bottom panel.

The hollow interior of the battery case 12 is divided into a pair of laterally spaced elongate battery chambers 32 by a depending central channel 34 defined within the top panel 18 and formed along substantially the entire length thereof inward from a forward end 36 opening through the front wall 22. As will be noted, the channel 34 is upwardly opening and of a substantially constant depth along its entire length. The battery chambers 32 defined within the hollow interior of the battery case 12 to the opposite sides of the central channel 34 are, in the preferred embodiment, of a width and length to closely receive a pair of aligned AA batteries 38 with the arcuate edges defined between the top panel 18 and the side walls 20 conforming to and providing a nesting seat for the cylindrical batteries 38. As will be noted particularly in FIG. 6, the mounted bottom panel 26 retains the batteries 38 in nested position within the chambers 32 and in proper engagement with their contacts. Should a longer battery life be desired, the transverse width of each battery chamber 32 can be increased to accommodate four batteries in each chamber. However, the illustrated embodiment with narrow chambers to accommodate two batteries in each chamber is preferred in providing for a compact and streamline portable light. It will be recognized the size of the battery case 12 itself will be defined by the diameter of a single battery and the combined length of two batteries.

The telescopic support arm 16 is formed of two hollow elongate arm shafts, a proximal shaft 40 having the proximal end thereof mounted within the channel 34 at the closed rear or inner end thereof adjacent the rear wall 24 of the battery case 12, and a distal arm shaft 42 pivotally mounting the lamp housing 14 on the distal end thereof. The shaft 42 is telescopically received within the shaft 40 for selective forward extension and retraction relative thereto. Both shafts are preferably rectangular in cross section and of a complementary size whereby the inner shaft 42 is precluded from rotation within the outer shaft 40.

Noting the detail view of FIG. 7, the inner shaft 42 includes an elongate groove 44 longitudinally along one or both of the opposed sides thereof which cooperates with an inwardly directed groove-receiving lug 46 on the corresponding side wall of the outer arm shaft 40 to limit the extension and retraction of the inner shaft 42 relative to the outer shaft 40 by engagement of the lug 46 with the opposed ends of the slot 44.

With reference to FIGS. 4 and 7, inasmuch as it is desired that the inner shaft 42 be stabilized at any of a plurality of longitudinally adjusted positions, a series of equally spaced transverse grooves 48 are formed in the top wall of the inner shaft 42 for selective reception therein of a depending rib 50 on a flap 52, preferably defined directly from the top wall of the outer arm shaft 40 and slightly flexible relative thereto, to provide a general detent arrangement between the grooves 48 and rib 50 which, while allowing for a sliding adjustment of the inner shaft within the outer shaft, also provides a sufficient frictional resistance to movement of the inner shaft to require positive manual manipulation. As an alternative, the tolerances between the inner and outer shafts can be such as to in themselves provide sufficient frictional resistance to maintain the inner shaft in its adjusted position.

The lamp housing 14 is of a transverse width equal to or slightly less than that of the battery case 12, and includes a rear panel 54, opposed side panels 56, a top panel 58 and a front panel 60 defining a forwardly and downwardly arcing continuation of the top panel 58.

A hinge assembly 62 extends generally centrally from the rear panel 54 of the lamp housing 14 and mounts the lamp housing 14 to the distal end of the arm shaft 42 for pivotal adjustment about a first horizontal axis 64 which parallels the axis about which the proximal end of the proximal arm shaft 40 pivots within the channel 34, and about a vertical axis 66 at right angles to the axis 64. So mounted, the lamp housing, through pivotal movement about the horizontal axis 64, can be maintained in a horizontal orientation throughout the vertical adjustment of the arm 16, and can simultaneously be swung from side to side as considered best to illuminate the work area. While the hinge assembly 62 has been illustrated as comprising, at each of the axes 64 and 66, pivot pins engaged between projecting ears, other hinge assemblies can also be used. It is of course to be appreciated that, through frictional engagement, detents, or the like, the lamp housing 14 is to be retained in its adjusted position until manually moved therefrom.

The inner surface of the lamp housing 14 will preferably include an internal light reflector with the illumination providing bulb 68 mounted within an appropriate socket accessible through the rear panel 54. The socket is appropriately wired, through a freely expanding elongate coiled conductor 70, to a switch 72 mounted adjacent the inner end of the arm-receiving channel 34. The switch is in turn appropriately wired to the batteries and is operative to close the circuit to the bulb 68 as the arm 16 is moved upwardly from its closed or nested position within the channel 34, and open the circuit as the arm is returned to its nested position. The switch, schematically shown herein, can be of any appropriate type, for example as illustrated in either of applicant's above mentioned prior patents.

The actual pivotal mounting of the proximal end of the arm 16 can be achieved by oppositely directed lugs, either defined by integral projections or a transverse pivot shaft, extending from the opposite sides of the proximal arm shaft and engaged within appropriate journal-defining apertures within the opposed side walls of the channel 34. The upwardly pivoted vertical positioning of the support arms 16 is to be maintained by frictional engagement of the proximal end portion of the arm between the channel walls, by detent means, or by any other appropriate means until such time as the arm is manually readjusted.

The support arm 16, when pivoted downward into its closed or nested position within the channel 34, has the upper surface thereof, defined by the proximal shaft 40, coplanar with the upper surface of the top panel 18 of the battery case 12 and with the width of the proximal arm shaft 40 closely conforming to the width of the channel 34 whereby a smooth planar upper surface is provided. Similarly, when the distal arm shaft 42 is completely telescoped within the proximal arm shaft 40, the length of the arm 16 is coextensive with the length of the channel 34 with the lamp housing 14 positioned with the inner or rear panel 54 thereof closely adjacent the front wall 22 of the battery case 12 and with the top panel 58 of the lamp housing also substantially coplanar with the top panel 18 of the battery case 12.

In order to close the bulb compartment of the lamp housing 14, and conceal and protect the bulb in the compacted or closed position of the desk light 10, a planar closure plate 76 is fixed to and extends forward from the lower edge portion of the front wall 22 of the battery case 12. This closure plate 76 is dimensioned to receive and close the open lower face of the lamp housing as the support arm is collapsed and swung to its nested position with the channel 34. As desired, the plate can be provided with an upwardly projecting peripheral lip 78 along the opposed edges and across the front edge thereof for frictional engagement with the corresponding edges of the lamp housing to retain the housing against the closure plate in the closed position of the desk light and until manually released therefrom.

A further feature of the desk light 10 is the incorporation therein of a bracket 80 mounted on the lamp housing 14 and particularly adapted to releasably engage and mount a magnification sheet or panel 82 in overlying relation to the viewing area and out of the direct path of the illumination. This bracket 80 comprises a transverse bar 84 which overlies the top panel 58 of the housing 14, and opposed depending legs 86 with inturned lower ends which engage beneath guide ribs 88 provided on the opposed side walls 56 of the housing 14 whereby the bracket is forwardly adjustable along the front to rear length of the housing 14 and vertically along the front panel 60 thereof. The cross bar 80 is positioned slightly above the housing outer surface and the magnifier sheet is frictionally engaged between this cross bar and the outer surface of the housing.

FIG. 8 illustrates another form of mounting bracket 90 which includes a flat sheet-gripping plate 92 overlying the top panel 58 of the lamp housing 14 and a depending bifurcated rear panel 94, the opposed edges of which are slidably received within closely conforming vertical channels 96 along the opposed vertical edges of the rear or inner panel 54 of the lamp housing 14. The bracket 90 with the open opposed ends of the top panel 92 is particularly adapted to mounts wider magnifier sheets which will frictionally engage between the top panel 92 of the bracket 90 and the top panel 58 of the lamp housing 14. The channel mounted arrangement of the bracket 90 allows for accommodation of magnifier sheets of varying thickness.

When compacted, the portable desk light 10 presents a smooth thin and narrow profile easily stored within one's coat pocket or in an attache case. In use, the lamp housing, through an upward swinging and forward extension of the support arm 16, is positioned at a convenient height, for example 102 to 105 millimeters for reading material, above a tabletop or the like with the battery case itself providing a stable support base. The weight of the batteries within the case counterbalances the upwardly extending and projected arm and lamp housing. As desired, appropriate non-skid pads 98 can be provided on the bottom panel 26 which encloses the hollow interior of the battery case 12.

The extendable nature of the support arm 16 is of particular significance in that the extension of the support arm can be coordinated with the upward pivoting of the support arm to ensure both a proper forward positioning of the lamp housing 14 and the elevation thereof relative to the work material. The pivotal mounting of the lamp housing on the distal end of the support arm is also significant in maintaining a horizontal orientation of the lamp housing regardless of the elevation thereof.

While not specifically limited thereto, it is contemplated that the support arm 16 be capable of extending to approximately 150% of its collapsed length, for example from 100 millimeters to 150 millimeters. The in-use length of the support arm can of course be varied between the extreme collapsed and extended positions.

The foregoing is considered illustrative of the principal features of the portable desk light of the invention.

I claim:

1. A portable desk light comprising a flat elongate battery case, a lamp housing, and an extensible support arm mounting said lamp housing to said battery case, said battery case including spaced generally parallel top and bottom panels, opposed side wall portions, and opposed front and rear walls portions defining a hollow interior within said case, an elongate upwardly opening channel defined in and along said top panel, said channel having an open forward end at said front wall portion and a closed inner end adjacent said rear wall portion of said battery case, said channel being of a depth, along the length thereof, extending substantially to said bottom panel, said channel defining a battery chamber to each side thereof between said channel and the corresponding side wall portion, said battery chambers extending the length of said battery case, said support arm having a proximal end and a distal end. said proximal end being pivotally mounted within said channel at said inner end for pivotal movement of said arm about an axis transverse to said channel between an open position upwardly angled from said battery case and a closed position wherein said arm is received within said channel, said arm being extensible between a collapsed position and an extended position, said arm in said collapsed position being of a length approximately equal to the length of said channel between said inner and outer ends thereof, means pivotally mounting said lamp housing to said distal end of said arm for pivotal movement of said lamp housing relative to said arm about a pivot axis parallel to the axis of pivotal movement of said arm relative to said battery case, said lamp housing, in the closed and collapsed position of said support arm, being positioned immediately forward of said front wall portion of said battery case.

2. The portable desk light of claim 1 wherein said bottom panel is removably mounted to allow access to said battery compartments for battery placement, said bottom panel being adapted to engage and retain placed batteries within said chamber and against said top panel.

3. The portable desk light of claim 2 wherein each battery chamber is elongate and narrow with a longitudinal extent thereof between said top panel and the corresponding side wall portion defining a transverse circular arc adapted to receive and conform to a standard cylindrical battery.

4. The portable desk light of claim 3 wherein said extensible support arm includes elongate proximal and distal hollow arm shafts, said proximal shaft including said proximal end mounted within said channel, said distal shaft being telescopically received in and selectively extensible from said proximal shaft through an end thereof remote from said proximal end for adjustment of said support arm between said collapsed and extended positions, said proximal shaft being of a length approximately equal to the length of said channel and of a width approximately equal to the width of said channel, said proximal shaft including an upper face which, in said closed position of said support arm, defines a common planar top surface with said top panel of said battery case.

5. The portable desk light of claim 4 wherein said distal shaft is incrementally extensible relative to said proximal shaft, and detent means releasably retaining said distal shaft in any adjusted position thereof, and means defining the maximum collapsed and extended positions of said distal shaft.

6. The portable desk light of claim 5 wherein said lamp housing, in the closed position of said support arm, is positioned immediately forward of said front wall portion of said battery case, and a closure plate extending forwardly from said front wall portion substantially coplanar with said bottom panel and in underlying relation to said lamp housing for seated engagement of said lamp housing on said closure plate in said closed position of said support arm, said lamp housing including a downwardly opening bulb compartment which is closed upon seating engagement of said lamp housing on said closure plate.

7. The portable desk light of claim 6 wherein said lamp housing includes a top panel, and bracket means mounted to said housing in overlying relation thereto and defining means for engaging and supporting an accessory in forwardly projecting relation to said lamp housing.

8. The portable desk light of claim 7 wherein said lamp housing includes opposed side panels depending from the housing top panel, said housing side panels including front-to-rear rib means thereon, said bracket means comprising a transverse bar overlying said housing top panel, a pair of legs depending from said bar and overlying said housing side panels, and means on said legs engaging said rib means for selective travel therealong between forward and rear positions on said housing top panel.

9. The portable desk light of claim 7 wherein said bracket means includes a flat panel overlying said housing top panel in closely spaced relation thereabove and defining a forwardly opening space therebetween for sliding reception of an accessory therein.

10. The portable desk light of claim 5 wherein said detent means includes multiple recesses defined at spaced points along said distal shaft, and a projection on said proximal shaft selectively engaging in said recesses upon adjustment of said distal shaft within said proximal shaft.

11. The portable desk light of claim 4 including conductor means between said battery compartments and said bulb compartment, said conductor means including an elongate resiliently expandable and contractible coil portion extending longitudinally through said extensible arm for selective expansion and contraction in conjunction with movement of said arm between said collapsed position and said extended position.

12. The portable desk light of claim 1 wherein said extensible support arm includes elongate proximal and distal hollow arm shafts, said proximal shaft including said proximal end mounted within said channel, said distal shaft being telescopically received in and selectively extensible from said proximal shaft through an end thereof remote from said proximal end for adjustment of said support arm between said collapsed and extended positions, said proximal shaft being of a length approximately equal to the length of said channel and of a width approximately equal to the width of said channel, said proximal shaft including an upper face which, in said closed position of said support arm, defines a common planar top surface with said top panel of said battery case.

13. The portable desk light of claim 12 wherein said lamp housing, in the closed position of said support arm, is positioned immediately forward of said front wall portion of said battery case, and a closure plate extending forwardly from said front wall portion substantially coplanar with said bottom panel and in underlying relation to said lamp housing for seated engagement of said lamp housing on said closure plate in said closed position of said support arm, said lamp housing including a downwardly opening bulb compartment which is closed upon seating engagement of said lamp housing on said closure plate.

14. The portable desk light of claim 1 wherein said lamp housing includes a top panel, and bracket means mounted to said housing in overlying relation thereto and defining means for engaging and supporting an accessory in forwardly projecting relation to said lamp housing.

15. The portable desk light of claim 14 wherein said bracket means includes a flat panel overlying said housing top panel in closely spaced relation thereabove and defining a forwardly opening space therebetween for sliding reception of an accessory therein.

* * * * *